US006439480B1

(12) United States Patent
Velde

(10) Patent No.: US 6,439,480 B1
(45) **Date of Patent: *Aug. 27, 2002**

(54) DEVICE FOR AUTOMATIC SPRAY APPLICATION OF PAINT

(75) Inventor: Terje Velde, Stavanger (NO)

(73) Assignee: ABB Flexible Automation A/S, Byrne (NO)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/402,087

(22) PCT Filed: Mar. 30, 1998

(86) PCT No.: PCT/IB98/00461

§ 371 (c)(1),
(2), (4) Date: Dec. 22, 1999

(87) PCT Pub. No.: WO98/43745

PCT Pub. Date: Oct. 8, 1998

(30) Foreign Application Priority Data

| | | |
|---|---|---|
| Apr. 3, 1997 | (SE) | 9701203 |
| May 9, 1997 | (SE) | 9701745 |
| Aug. 6, 1997 | (SE) | 9702862 |

(51) Int. Cl.[7] ..... B65D 1/32

(52) U.S. Cl. ..... 239/327; 239/305; 239/321; 239/323; 222/326; 222/333

(58) Field of Search ..... 239/305, 320, 239/321, 323, 324, 327; 220/4.22; 222/326, 327, 333

(56) References Cited

U.S. PATENT DOCUMENTS

| | | | | |
|---|---|---|---|---|
| 798,093 A | * | 8/1905 | Dean | 239/327 |
| 2,224,967 A | * | 12/1940 | Kaye | 222/236 |
| 4,785,760 A | | 11/1988 | Tholome | |
| 5,238,029 A | | 8/1993 | Akeel | |
| 5,293,911 A | | 3/1994 | Akeel | |
| 5,328,095 A | * | 7/1994 | Wickenhaver | 239/113 |
| 5,411,211 A | * | 5/1995 | Greene et al. | 239/327 |
| 5,762,239 A | * | 6/1998 | Cossette | 222/326 |

FOREIGN PATENT DOCUMENTS

| | | |
|---|---|---|
| FR | 2 635 990 | 9/1988 |
| JP | 07227556 | 8/1995 |
| SE | 504 472 | 2/1997 |
| SE | 509 397 | 1/1999 |
| WO | WO 97/00731 | 1/1997 |
| WO | WO 98/43745 | 10/1998 |

* cited by examiner

*Primary Examiner*—Lesley D. Morris
*Assistant Examiner*—Christopher Kim
(74) *Attorney, Agent, or Firm*—Connolly Bove Lodge & Hutz LLP

(57) ABSTRACT

A device is disclosed for the automatic spray application of paint. The device has a paint container and a spray nozzle arranged in close connection and adapted to provide paint from the container to the spray nozzle during the spray application. A dosing apparatus regulates the compression of an external surface against the inner volume of the paint container and thereby forces paint out of the container and into the spray nozzle through an opening of the container. A number of receiving members are adapted to receive and hold the paint container close to the spray nozzle, such that the paint container is detachable and removable from the device when replacing a paint container. The paint container has an elongated feeding tube, at its opening, that is held by the receiving members when the tube is inserted in the nozzle.

17 Claims, 3 Drawing Sheets

DEVICE FOR AUTOMATIC SPRAY APPLICATION OF PAINT

FIELD OF THE INVENTION AND PRIOR ART

The present invention relates to a device for automatic spray application of paint through a spray nozzle. This device comprises a unit adapted to be connected and provide paint to the nozzle during the automatic spray application.

Such a device may have different fields of uses. For illuminating, but not in any way restricting the invention, the use of such a device for painting vehicle bodies, with a spray application robot will hereinafter mainly be discussed. Though paints are referred to in this application, this term is given a broad meaning to include paints of all types and varnishes suited for spray application.

Known devices of this type have a number of units providing paint. These units have centrally located paint sources that are positioned remotely with respect to the spray robot. Each unit is intended for a distinct paint source, one for each type of paint and color, and each is connected to the spray nozzle through a ring conduit. The selection of a paint source is controlled by valves arranged on the robot, thereby requiring a large number of valves, often more than 60. The remote location of the paint sources and numerous valves cause several important drawbacks, most especially when many types of paints and colors are to be sprayed by the spray robot. For each paint source, a hose connects the source unit to the spray robot. A large number of hoses running between the centrally located paint sources and the spray robot makes the device expensive and restricts the ability to move the spray robot. Furthermore, since each hose must be cleaned occasionally, using a large number of hoses increases the maintenance for cleaning and removing obstructions from them. Additionally, a large volume of paint is lost when a color or paint type is changed, since the hose lengths are long, the valves and paint control means are complex, and the new paint may not be mixed with the previous paint type.

Another drawback relates to water-born paints, which are more and more frequently used, since these paints have a higher viscosity than oil base paints. A higher pumping pressure is required for pumping higher viscosity paints to the spray robot and the risk of paint being deposited in and obstructing the hoses is increased. Furthermore, considerable problems arise in electrically insulating the paint sources and the spray nozzle when performing electrostatic painting when using water-born paints in conjunction with ring conduits.

SUMMARY OF THE INVENTION

The object of the present invention is to provide a device that solves the inconveniences mentioned above of such devices already known.

This object is obtained by a device, having a paint container arranged close to the spray nozzle. Additionally, the device has members adapted to receive and hold the container close to the spray nozzle. The container may be detached and removed from the device and exchanged with another such container when refilling and changing paint type.

Thus, the invention is based on locating the paint source unit in proximity with the spray nozzle, to reduce the connection length between the paint source and the nozzle while the paint is applied. The device avoids the need to use long ring conduits that are susceptible to plugging and that require a comparatively high amount of power to pump, especially when using pumping water-born paints having a high viscosity. The device does not require a large number of hoses and valves for feeding paint of different colors to the nozzle, but facilitates color change easily through replacement of the paint container. A container may be used continuously for the same color, so that no cleaning of the container is required before refilling it with paint. No insulating problems occur when using water-borne paints in connection with electrostatic painting, since the paint container is isolated from devices external to the spray robot, such as external paint reservoir. The container also serves to insulate materials on opposing sides of the container.

According to a preferred embodiment of the invention, the device comprises a means adapted to dose paint from the container to the spray nozzle during the spray application. This dosing means is adapted to influence the inner volume of the container holding paint. Paint is pressed out of the nozzle, through and opening, by reducing the volume of space within the container for holding paint. Feeding paint in this way provides a very exact and reliable dosing of the paint through a simple means.

According to another preferred embodiment of the invention, the paint dosing means is adapted to act upon the container by compressing its volume from the outside. The dosing means does not come into contact with the paint and, therefore, no cleaning of the dosing means is required when the paint container is changed. This feature saves time as well as paint and cleaner.

According to another preferred embodiment of the invention, the container is compressible, and said dosing means is adapted to compress the container. By such compression, a very exact dosing of paint to the spray nozzle may take place.

According to another preferred embodiment of the invention, he container has a bellows-like construction for facilitating compression of the container. A very exact and uniform dosing of paint to the spray nozzle may be achieved by this.

According to another preferred embodiment of the invention, the container has a wall that is displaceable with respect to the other walls of the container, while maintaining a tight delimitation of the volume. The dosing means is adapted to act upon the displaceable wall to displace the paint and thereby supply paint to the nozzle in controlled doses. This embodiment makes it possible to achieve an exact dosing of paint that is fed to the spray nozzle by a simple means.

According to another preferred embodiment of the invention, the dosing means comprises a power member having a piston and a piston rod. This dosing means is adapted to act upon the container by compressing the volume of the container with the piston. This design for feeding paint in a dosed manner to the spray nozzle makes a very exact dosing possible.

According to another preferred embodiment of the invention, the container is elongated at the opening to form a feeding tube adapted to be held by said receiving members when inserted in the nozzle. By providing the container with a feeding tube that extends all the way into the spray nozzle, the need to clean the paint paths of the device will be reduced. Moreover, the paint feeding path that requires cleaning is restricted, at most, to the end of the spray nozzle located downstream of the feeding tube. With this feature, the paint loss will be minimized when changing to a paint of another color.

According to another preferred embodiment of the invention, the device is arranged in a spray application robot having a nozzle located at the free end of one robot arm. Receiving members form a space inside the robot arm and are adapted to receive said container. With this arrangement, the container may be safely held in place and protected against external influences. Additionally, this arrangement provides a very compact reservoir to draw paint from during the spray application.

According to another preferred embodiment of the invention, the dosing means is arranged inside the robot arm in a space adjacent to the receiving member space holding the paint container. Thereby the dosing means is protected against external damage and both the paint container and the dosing means are stored compactly inside the robot arm.

According to a very preferred embodiment of the invention, said robot arm is arranged to be opened so that the container may be inserted or removed from the space formed by the receiving members. One end piece of the robot arm pivots with respect to the rest of the arm, about an axis substantially perpendicular to the longitudinal axis of the arm. The end piece has a space formed by the receiving members for receiving the container. A space, for the dosing means is arranged in the part of the robot arm connected to the end piece. This configuration makes it very simple to insert and remove a paint container without the dosing means being in the way.

Further advantages of the invention will appear from the following description.

BRIEF DESCRIPTION OF THE DRAWINGS

With reference to the appended drawings, a description of preferred embodiments of the invention, cited as examples, is provided below.

In the drawings.

DETAILED DESCRIPTION OF THE INVENTION

Figure 1:
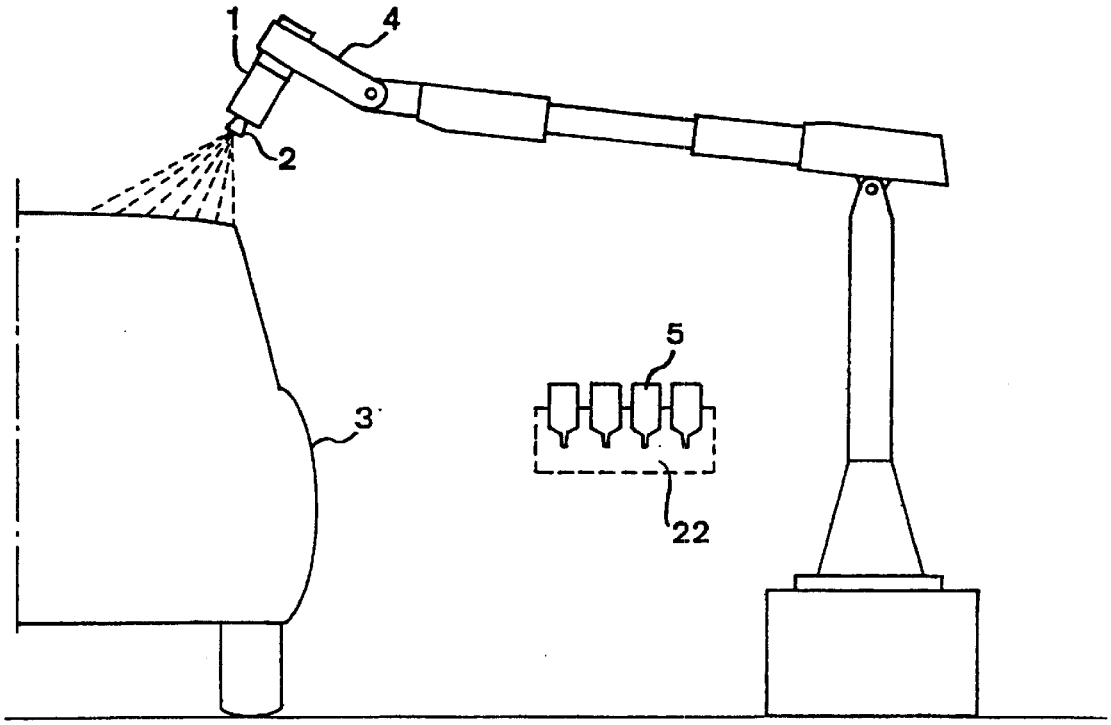
FIG. 1 is a schematic view of a robot for spray application of paint onto a vehicle body, in which this robot is provided with a paint container that is close to the spray nozzle.

In a preferred embodiment of the invention, a device for spray application of paint arranged in a spray application robot, which has different robot arms hingedly interconnected. This arrangement is schematically illustrated in FIG. 1. A spray nozzle 2, in the form of a gun another known form, is arranged on the last robot arm 1 for spray application of atomized paint onto an object 3, here a vehicle body. The robot arm 1 is pivoted with respect to an adjacent robot arm 4 for directing the spray nozzle 2 towards the object 3.

Figure 2:
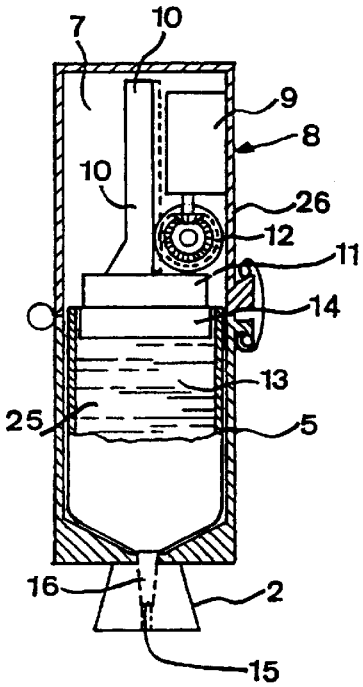
FIG. 2 is a view partially sectioned and enlarged, with respect to FIG. 1, of a device according to a first preferred embodiment of the invention.

It is illustrated in FIG. 2 how the robot arm 1 is adapted to receive a paint container 5 in a first space 6, inside robot arm 1. This container is held detachably and removably within the robot arm. A means for dosing paint fed from the container to the spray nozzle 2, for spray application, is arranged in a second space 7 adjacent to said first space 6. The dosing means comprises a power member 8, which has a motor 9, for example an electric motor, which is adapted to influence a piston rod 10. The influence upon the piston rod 10 is transferred to an attached piston 11 causing it to move either in a direction towards or away from the nozzle 2. This movement is achieved because the piston rod 10 and a gear wheel 12, driven by the motor 9, are constructed as a gear rack. When motor 9 drives the gear wheel 12, the interaction of the piston rod 10 and the gear wheel 12 moves the piston rod 10 and, thereby, the piston 11 in relation to the gear rack.

The container 5 has an inner volume 13 for receiving paint and the size of this inner volume may be changed by the wall 14 of the container that is displaceable with respect to the other walls of the container 5. Although wall 14 is displaceable, it maintains a tight delimitation of the volume 13 in conjunction with the other container walls. Piston 11 is adapted to bear against wall 14 of the container 5 so as to regulate the volume of the container 5. Piston 11 reduces the size of the container's volume to press paint out of container 5 to nozzle 2. Additionally, piston 11 assists in holding the container in place within the robot arm 1.

Container 5 has a feeding tube 16 at its opening 15, to nozzle 2, through which the elongated portion of the container is inserted, when the container is received in the robot arm 1. Furthermore the opening of the container has closing members, schematically indicated at 17, adapted to close the opening during transport and positioning of the container into the robot arm 1. The closing members prevent paint from leaving the container. Conventional spray members, not shown, are arranged in the nozzle for atomizing the paint.

Figure 3:
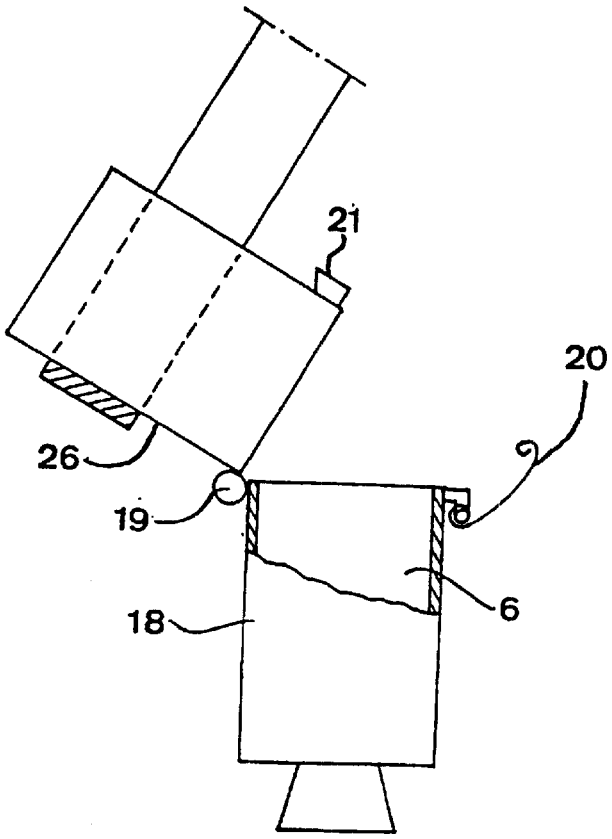
FIG. 3 is a partially sectioned view of the device, shown in FIG. 2, in a position in which it has no container but is ready for receiving a new container.

FIG. 3 illustrates how the robot arm 1 may be opened for inserting the container into and removing it from space 7. End piece 18 of the robot arm is pivotable, with respect to the rest of the arm 26, about an axis 19 substantially perpendicular to the longitudinal axis of the arm 26. Members 20, 21 are arranged on the end piece 18 and the part of the robot arm located upstream, respectively, for locking these two parts to each other after inserting a container into space 6. By adjusting the robot arm 1 in an appropriate way when changing the container, gravitation may be utilized for holding the end piece 18 in a position that makes the container change operation easier. This position of the robot arm is illustrated in FIG. 3. However, it is also possible to arrange the axis 19 so that a lateral pivoting of the end piece 18 is achievable to ease the operation of opening and closing robot arm 1.

FIG. 1 illustrates a supply 22 of containers 5 within reach of the robot, so that the robot may go there and change the container when color change is desired or the paint in the container has run out. A filling means, not shown, for filling the containers 5 is preferably located at or in close proximity to the supply 22.

Figure 4:
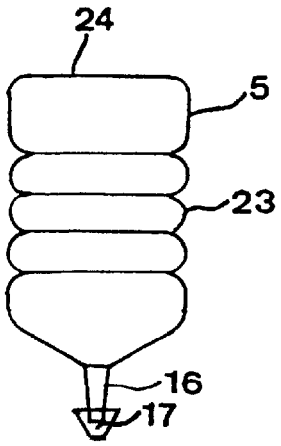
FIG. 4 is a view of a container, according to a possible design of the device.

Another preferred embodiment of a container 5, usable in a device according to the invention, is illustrated in FIG. 4. This container 5 is made of plastic and has a bellows-like construction 23 for facilitating compression of the container. Piston 11 acts upon the rear surface 24 of the container 5 to compress and force paint, in a dosed manner through the feeding tube 16 to the nozzle 2.

Figure 5:
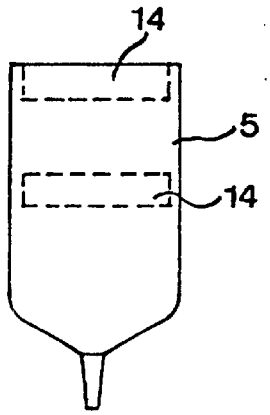
FIG. 5 is a view illustrating a container, corresponding to FIG. 4, according to another preferred design.

The embodiment of the container 5, usable in a device according to the present invention and shown in FIG. 2, is schematically shown in FIG. 5. It is illustrated, by dashing, that the wall 14 is moveable towards and away from the feeding tubes 16 so as to regulate the feeding of paint, in a dosed manner, through the spray nozzle 2.

Furthermore, the device has certain parts, having nothing to do with the invention and which have therefore not been shown in the figures, such as conduits for energy supply to the motor 9 and means for bringing the paint 25, contained in container 5, to high voltage potential for use in electrostatic painting.

Figure 6:
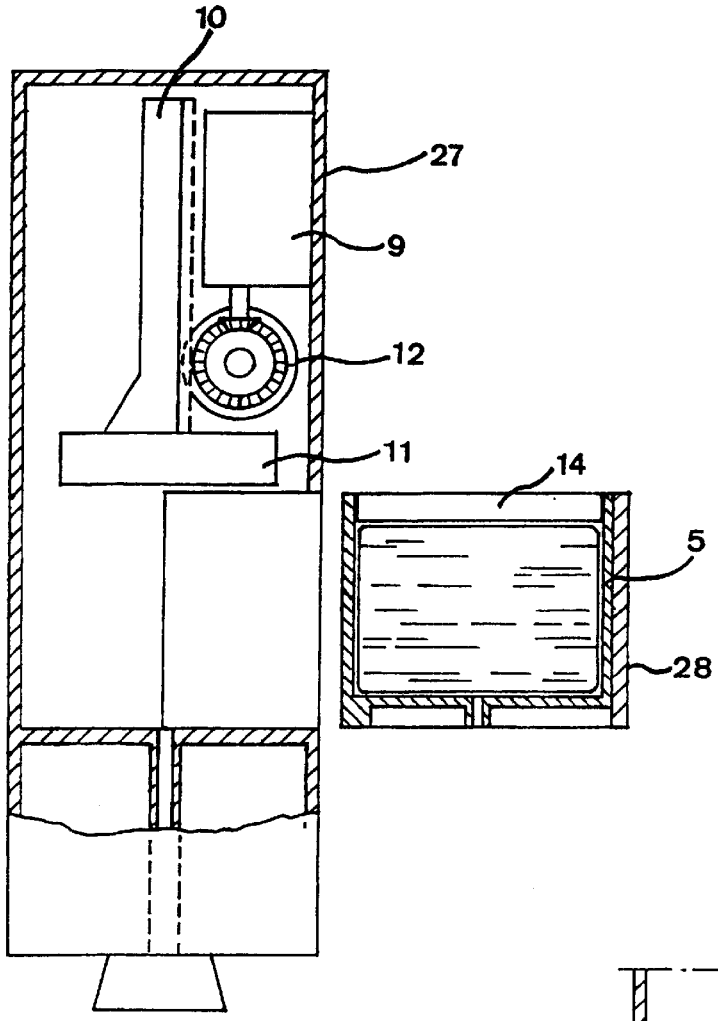
FIG. 6 is a view, corresponding to FIG. 2 of a device according to another preferred embodiment of the invention.

It is illustrated in FIG. 6 how, according to another preferred embodiment of the invention, the container 5 may be inserted into and taken out of the applicator body 27 of a spray robot, through a lateral translation movement. The container 5 is provided with an end wall 14 that is displaceable with respect to the other walls of the container. The container 5 is received in a holder 28 forming a part of the applicator body. The container 5 may be removed from the holder 28 and a new, filled container may be introduced into the holder, when the holder 28 is removed from applicator body 27.

Figure 7:
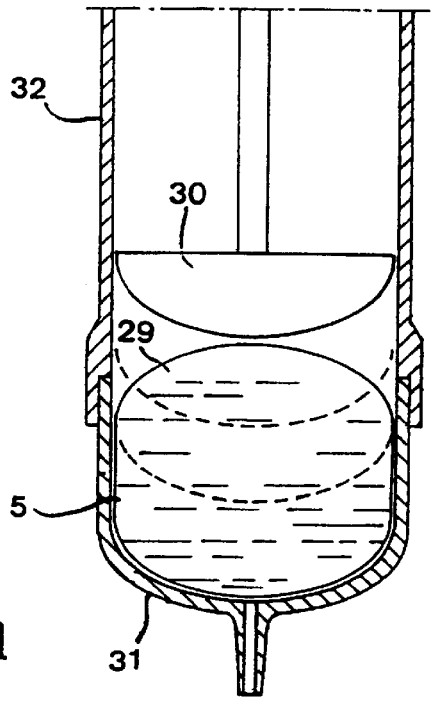
FIG. 7 is a view, illustrating an additional possible design of a part of a device according to the invention.

In another preferred embodiment, the container 5 has a round flexible top portion 29, as illustrated in FIG. 7, that may be compressed by a piston 30 for dosing paint. Piston 30 is driven by a motor and has a shape corresponding to the shape of the bottom of a solid body 31, in which the container 5 is arranged. Piston 30 pushes paint out through the container by compressing the container 5. Different possible positions of the piston are illustrated by the dashed lines in FIG. 7. The solid body is removable from the body 32 containing the piston, to facilitate changing the container. Solid body 31 and the body 32 may be connected to each other through, for example, a thread connection, a bayonet connection, or any type of snap-in connection.

The invention is not restricted to the preferred embodiments described above. The scope of the invention covers modifications that would be apparent to a person skilled in the art, without departing from the basic idea of the invention.

Other power members may, for example, be arranged for compressing the paint container 5 to feed the paint in a dosed manner out through the nozzle 2.

The container could have a toothpaste tube-like appearance and the dosing means may comprise members, such as rolls, that gradually compress the tube from one end toward the opening of the container to feed paint in a dosed manner therethrough.

What is claimed is:

1. A device for automatic spray application of paint, comprising:

a spray nozzle (2);

a spray application robot having the spray nozzle (2) located at a free end of a robot arm (1);

a paint container (5) arranged in close connection to the spray nozzle and providing paint to the spray nozzle during the spray application, the paint container having an elongated feeding tube (16) at an opening (15) of the paint container;

a number of receiving members (6, 18) receiving and holding the paint container close to the spray nozzle such that the paint container is detachable and removable from the device when replacing a paint container, the receiving members have a first space (6) that is delimited inside the robot arm and adapted to receive the paint container (5), and the elongated feeding tube (16) is held by the receiving members (6, 18) when the feeding tube is inserted in the nozzle (2); and a dosing means (8–12) for dosing paint from the paint container (5) to the spray nozzle by regulating the compression of an inner volume (13) of the paint container and thereby forcing paint out of the paint container and into the spray nozzle through the opening (15) of the paint container, the dosing means (8–12) is arranged inside the robot arm (1) in a second space (7) adjacent to the first space (6), and the dosing means is adapted to influence an external surface of the paint container (5), wherein the robot arm (1) can be opened for inserting and taking out the paint container (5), into and out of the first space (6), respectively, by the arrangement of an end piece of the receiving members of the arm being pivotable with respect to the rest of the arm, about an axis substantially perpendicular to the longitudinal axis of the arm.

2. A device according to claim 1, characterized in that the closing container (5) is compressible, and that said means is adapted to compress the container.

3. A device according to claim 2, characterized in that at least portions of the container (5) have bellows-like construction (23) for facilicating the compression of the container.

4. A device according to claim 1, characterized in that the external surface of the container (5) is displaceable with respect to the elongated feeding tub of the container while maintaining a tight delimation of the paint container inner volume (13) and that the dosing means is adapted to act upon said displaceable wall for dosing paint to the spray nozzle.

5. A device according to claim 1, characterized in that the dosing means comprises a power member (8), having a piston (11) and a piston rod (10), that is adapted to act upon the paint container (5) by using the piston to compress the paint container inner volume (13).

6. A device according to claim 1, characterized in that the elongated feeding tube (16) is held by said receiving members (6, 18) when inserted in the spray nozzle (2).

7. A device according to claim 1, characterized in that the opening (15) of the paint container (5) is provided with a member (17) adapted to close the opening and prevent paint from leaving the paint container.

8. A device according to claim 1, characterized in that said end piece (18) comprises the first space (6) for receiving the container.

9. A device according to claim 1, characterized in that the second space (7) is arranged in a part (26) of the robot arm connecting to the end piece of the receiving members.

10. A device according to claim 2, wherein the dosing means comprises a power member having a piston and a piston rod and is adapted to act upon the paint container by using the piston to compress the paint container volume.

11. A device according to claim 3, wherein the dosing means comprises a power member having a piston and a piston rod and is adapted to act upon the paint container by using the piston to compress the paint container volume.

12. A device according to claim 4, wherein the dosing means comprises a power member having a piston and a piston rod and is adapted to act upon the paint container by using the piston to compress the paint container inner volume (13).

13. A device according to claim 2, wherein the elongated feeding tube is held by said receiving members (6, 18) when inserted in the spray nozzle (2).

14. A device according to claim 3, wherein the elongated feeding tube is held by said receiving members (6, 18) when inserted in the spray nozzle (2).

15. A device according to claim 4, wherein the elongated feeding tube is held by said receiving members (6, 18) when inserted in the spray nozzle (2).

16. A device according to claim 5, wherein the elongated feeding tube is held by said receiving members (6, 18) when inserted in the spray nozzle (2).

17. A device according to claim 1, wherein the dosing means has a piston, a piston rod, a gear wheel, and an electric motor;

the gear wheel and the piston rod are configured as a gear rack driven by the electric motor;

one surface of the piston is connected to the piston rod and another surface of the piston contacts the external surface of the paint container to exert influence on the inner volume of the paint container; and the dosing means influences the inner volume of the paint container when the electric motor drives the gear wheel and causes the piston rod and the piston to move in relation to the nozzle.

* * * * *